US007567217B1

(12) United States Patent
Chen

(10) Patent No.: US 7,567,217 B1
(45) Date of Patent: Jul. 28, 2009

(54) ANTENNA DEVICE

(75) Inventor: Shui-Hsu Chen, Changhua (TW)

(73) Assignee: Universal Scientific Industrial Co., Ltd, Nan-Tou Hsien (TW)

( * ) Notice: Subject to any disclaimer, the term of this patent is extended or adjusted under 35 U.S.C. 154(b) by 0 days.

(21) Appl. No.: 12/048,296

(22) Filed: Mar. 14, 2008

(51) Int. Cl.
*H01Q 1/50* (2006.01)
*H01Q 1/24* (2006.01)

(52) U.S. Cl. ..... 343/906; 343/702

(58) Field of Classification Search ..... 343/702, 343/906, 878, 880, 882
See application file for complete search history.

(56) References Cited

U.S. PATENT DOCUMENTS 7,400,301 B2 * 7/2008 Chan ..... 343/702
2006/0284771 A1 * 12/2006 Liang et al. ..... 343/702
2007/0085756 A1 * 4/2007 Chan ..... 343/906
2007/0097013 A1 * 5/2007 Chen ..... 343/906
2007/0247375 A1 * 10/2007 Huang ..... 343/702

* cited by examiner

*Primary Examiner*—Hoang V Nguyen
(74) *Attorney, Agent, or Firm*—Duane Morris LLP

(57) ABSTRACT

An antenna device includes a connecting component and an antenna. The connecting component includes a surrounding wall that has a receiver connecting portion adapted to be connected to a receiver, and an antenna connecting portion extending from the receiver connecting portion in a longitudinal direction. The antenna connecting portion has a slit extending from an end surface thereof in the longitudinal direction and defined by a slit-defining wall that has a pair of opposite wall sections. The wall sections are formed respectively with a pair of engaging portions. The antenna is connected pivotally to the antenna connecting portion of the surrounding wall, and is movable relative to the connecting component between a first position, where the antenna extends into the slit and is clamped tightly between the engaging portions, and a second position, where the antenna ceases to extend into the slit.

15 Claims, 4 Drawing Sheets

ANTENNA DEVICE

BACKGROUND OF THE INVENTION

1. Field of the Invention

The invention relates to an antenna, more particularly to an antenna device for a receiver.

2. Description of the Related Art

FIG. 1 illustrates a conventional antenna device 6 adapted for use with a receiver 5 (e.g., a wireless access point). The conventional antenna device 6 comprises a connecting component 61 adapted to be connected to the receiver 5, and an antenna 62. The antenna 62 includes a coupling section 621 connected pivotally to the connecting component 61, and a transceiver section 622 extending from the coupling section 621. The transceiver section 622 of the antenna 62 can be moved to a certain position for a relatively high quality of transmission and reception by rotating the coupling section 621 of the antenna 62 relative to the connecting component 61.

However, since the coupling section 621 of the antenna 62 is positioned relative to the connecting component 61 sorely through the friction force therebetween, and since wear between the coupling section 621 and the connecting component 61 will gradually weaken the friction force therebetween, the coupling section 621 will eventually lose its ability to be positioned firmly relative to the connecting component 61 after long-term use, thereby resulting in a relatively short service life of the conventional antenna device 6.

SUMMARY OF THE INVENTION

Therefore, the object of the present invention is to provide an antenna device having an antenna that can be positioned firmly at a certain position even after long-term use.

Accordingly, an antenna device of the present invention is adapted for use with a receiver. The antenna device comprises a connecting component and an antenna. The connecting component has a surrounding wall that defines a receiving space and that has a receiver connecting portion adapted to be connected to the receiver, and an antenna connecting portion extending from the receiver connecting portion in a longitudinal direction. The antenna connecting portion has a first end surface, and a first slit that extends from the first end surface in the longitudinal direction toward the receiver connecting portion and that is in spatial communication with the receiving space. The first slit is defined by a first slit-defining wall having a pair of wall sections opposite to each other in a transverse direction transverse to the longitudinal direction. The antenna connecting portion further has a pair of first engaging portions formed on the wall sections of the first slit-defining wall, respectively. The antenna is connected pivotally to the antenna connecting portion of the surrounding wall of the connecting component, and is movable relative to the connecting component between a first position, where the antenna extends into the first slit in the antenna connecting portion and is clamped tightly between the first engaging portions of the surrounding wall, and a second position, where the antenna ceases to extend into the first slit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
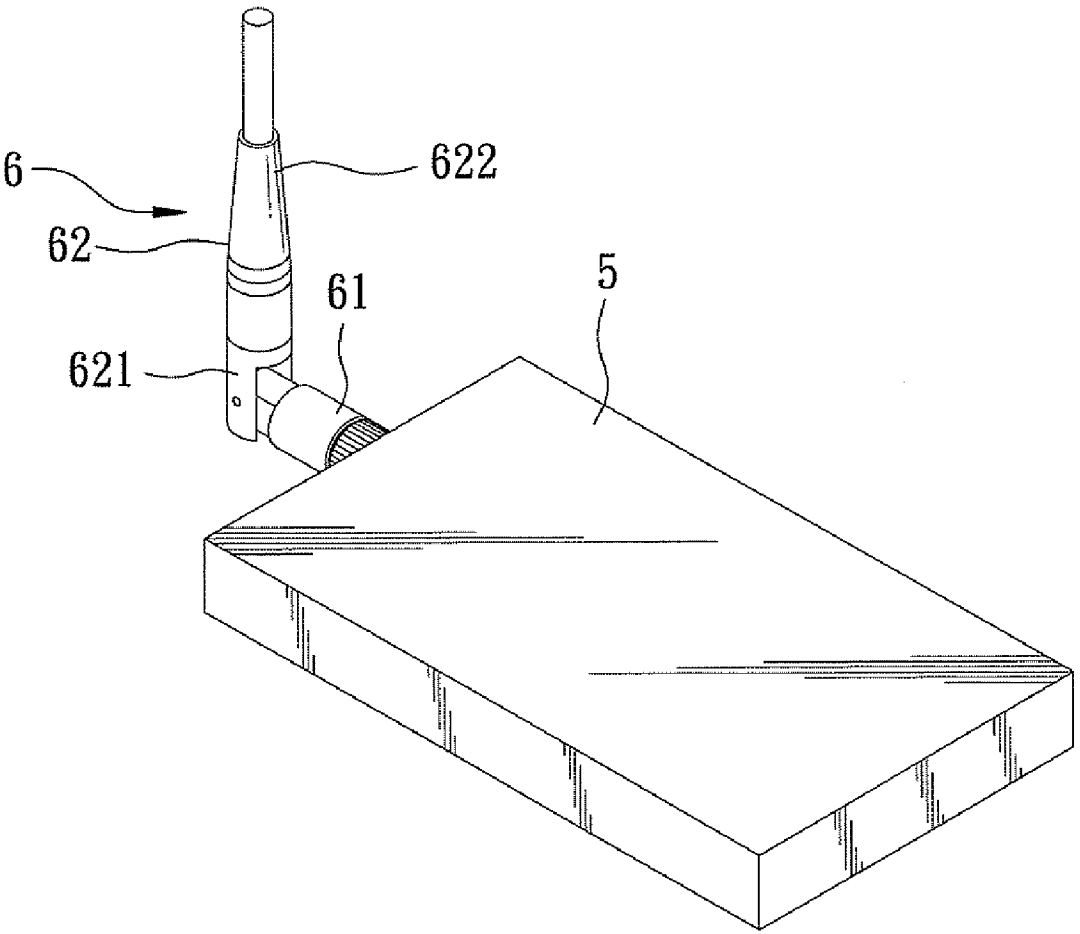
FIG. 1 PRIOR ART
FIG. 1 is a perspective view of a conventional antenna device connected to a receiver.
Figure 2:
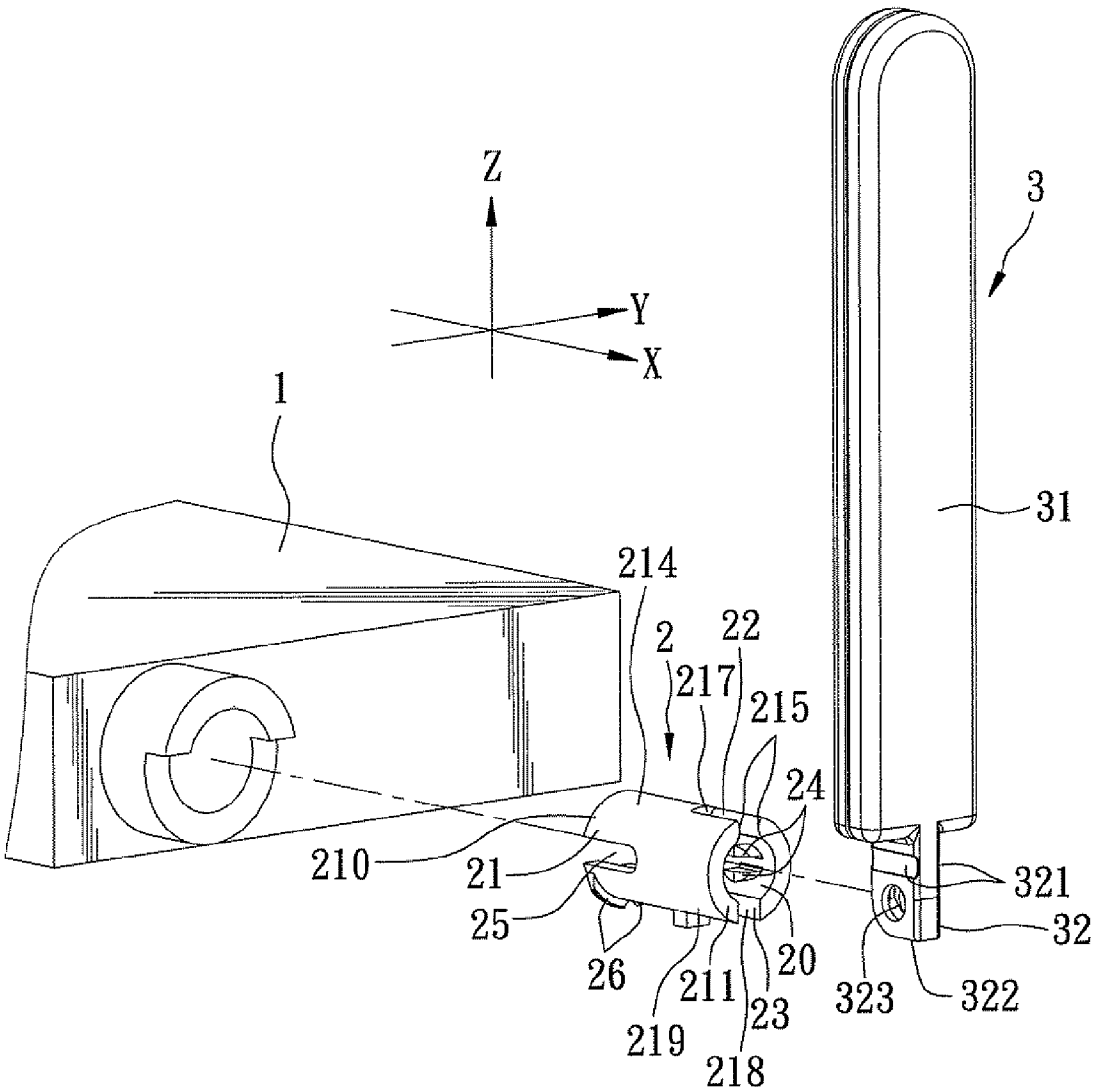
FIG. 2 is an exploded perspective view of a preferred embodiment of an antenna device according to the invention.
Figure 3:
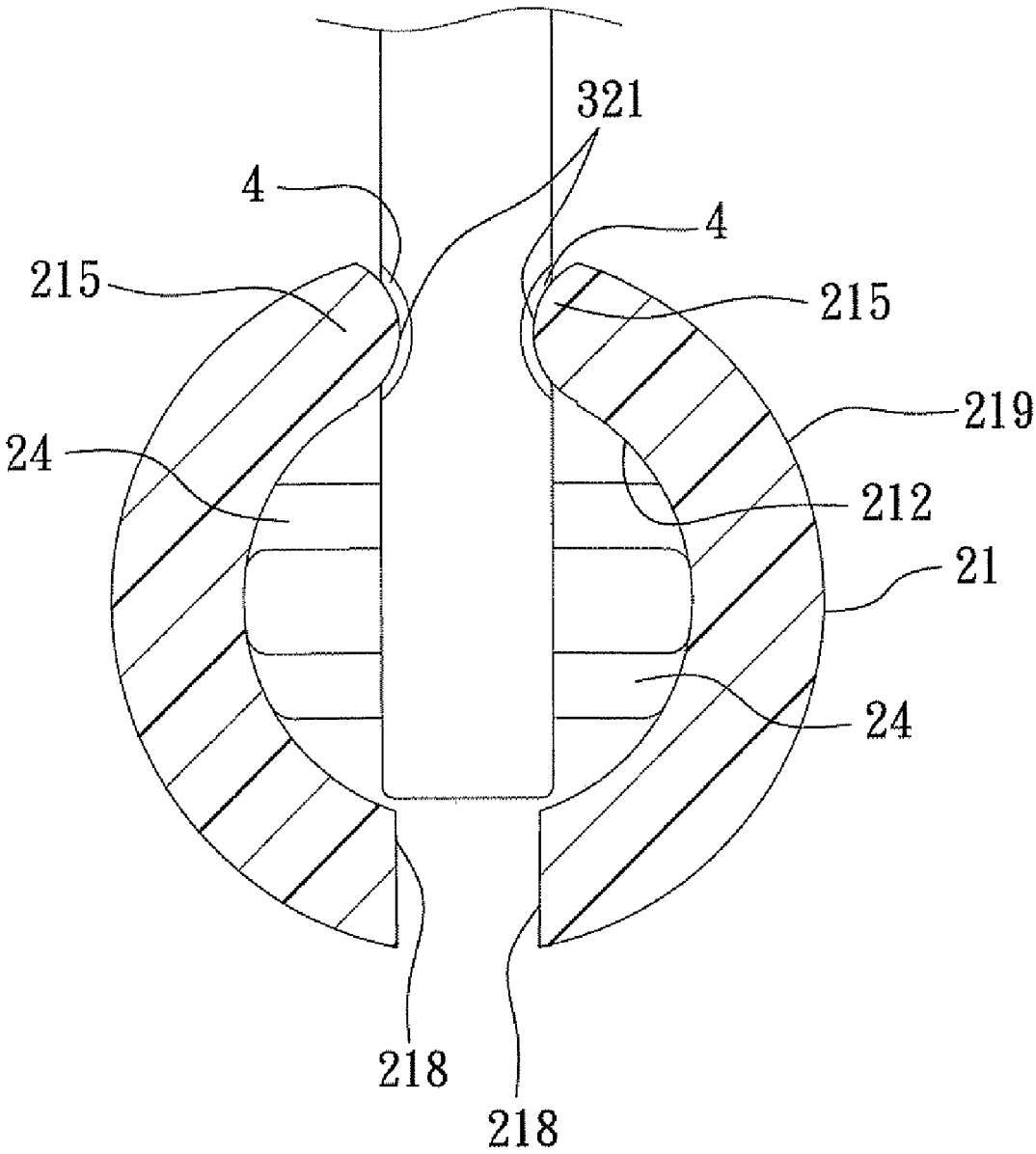
FIG. 3 is a fragmentary sectional view of the preferred embodiment when an antenna is at a first position.
Figure 4:
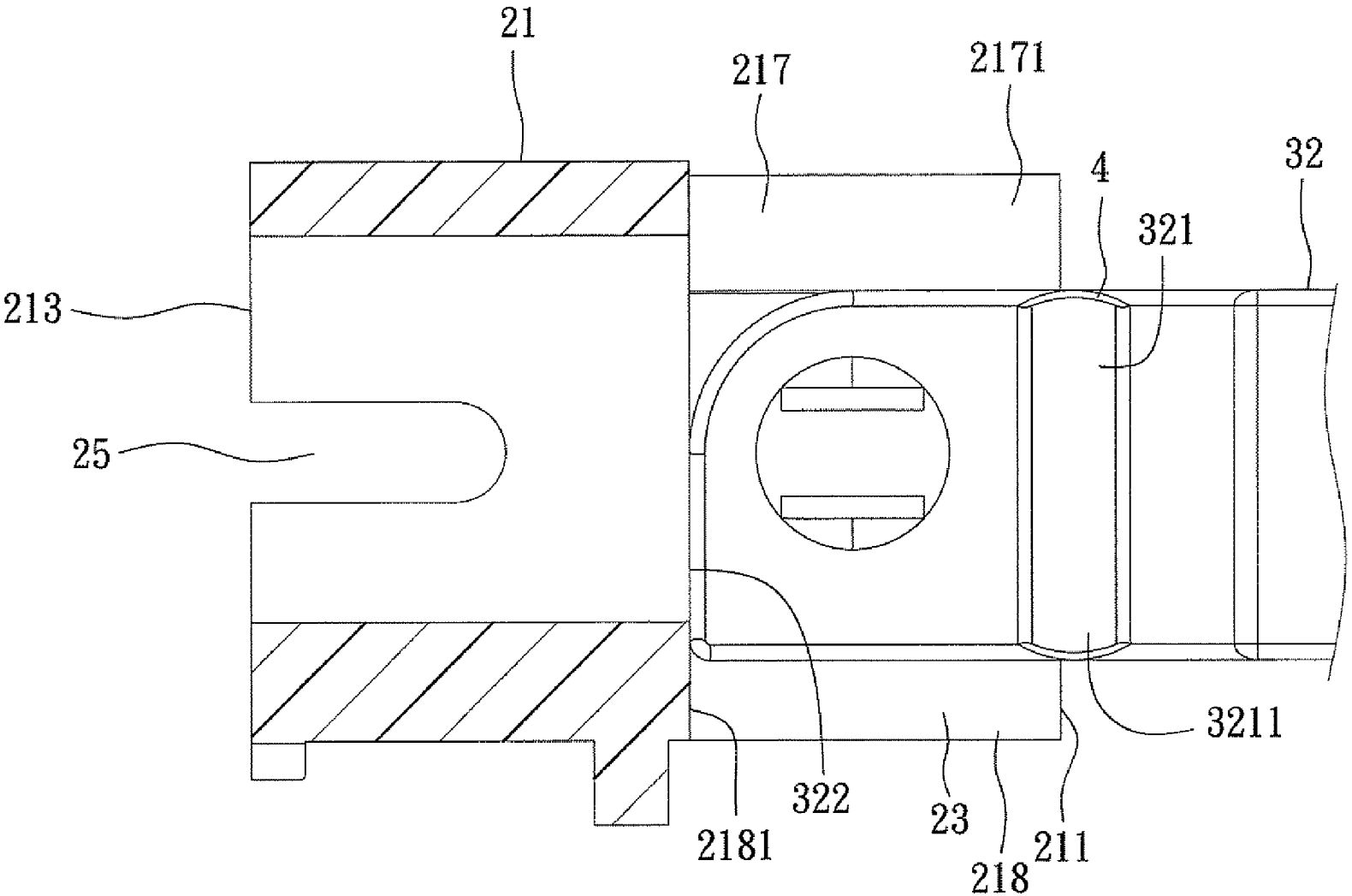
FIG. 4 is another fragmentary sectional view of the preferred embodiment when the antenna is at a second position.

As shown in FIGS. 2 to 4, the preferred embodiment of an antenna device according to the present invention is adapted for use with a receiver 1, and comprises a connecting component 2, an antenna 3 connected pivotally to the connecting component 2, and a plurality of guide surfaces 4.

The connecting component 2 has a surrounding wall 21 that defines a receiving space 20 and that has a receiver connecting portion 210 adapted to be connected rotatably to the receiver 1, and an antenna connecting portion 219 extending from the receiver connecting portion 210 in a longitudinal direction (X).

The antenna connecting portion 219 has a first end surface 211 and a first slit 22 that extends from the first end surface 211 in the longitudinal direction (X) toward the receiver connecting portion 210 and that is in spatial communication with the receiving space 20. The first slit 22 is defined by a first slit-defining wall 217 having a pair of wall sections 2171 (only one is visible in FIG. 4) opposite to each other in a first transverse direction (Y) transverse to the longitudinal direction (X). The antenna connecting portion 219 further has a pair of first engaging portions 215 formed on the wall sections 2171 of the first slit-defining wall 217, respectively. The antenna connecting portion 219 further has a second slit 23 that extends from the first end surface 211 in the longitudinal direction (X) toward the receiver connecting portion 210, that is disposed at a position opposite to the first slit 22 in a second transverse direction (Z) transverse to the longitudinal direction (X) and the first transverse direction (Y), and that is in spatial communication with the receiving space 20. The second slit 23 is defined by a second slit-defining wall 218 having an abutment wall segment 2181 that is spaced apart from the first end surface 211 in the longitudinal direction (X). In this embodiment, the antenna connecting portion 219 further has an internal surrounding surface 212 provided with a plurality of pivot portions 24.

In this embodiment, the receiver connecting portion 210 has a second end surface 213 that is formed opposite to the first end surface 211 of the antenna connecting portion 219 in the longitudinal direction (X), a plurality of spaced apart third slits 25 (only one is visible) that extend from the second end surface 213 in the longitudinal direction (X) toward the antenna connecting portion 219, that are in spatial communication with the receiving space 20, and that impart resiliency to the receiver connecting portion 210, and an external surrounding surface 214 that is formed with a plurality of flanges 26 adapted for coupling rotatably the connecting component 2 to the receiver 1.

In this embodiment, the antenna 3 has a transceiver section 31, and a coupling section 32 that extends from the transceiver section 31, that is connected pivotally to the antenna connecting portion 219 of the surrounding wall 21 of the connecting component 2, and that is formed with a pair of second engaging portions 321 at opposite sides thereof in the first transverse direction (Y), a stop surface 322 at one edge distal from the transceiver section 31, and a pivot hole 323 such that the pivot portions 24 of the antenna connecting portion 219 extend into the pivot hole 323 to connect pivotally the antenna 3 to the antenna connecting portion 219. The first engaging portions 215 of the antenna connecting portion 219 have a shortest distance therebetween that is slightly shorter than that between the second engaging portions 321. One of each of the first engaging portions 215 and each of the second engaging portions 321 is in a form of a recess, while the other one of each of the first engaging portions 215 and each of the second engaging portions 321 is in a form of a protrusion. In this embodiment, each of the first engaging portions 215 is in a form of a protrusion, while each of the second engaging portions 321 is in a form of a recess and has a recess-defining wall 3211 (see FIG. 4).

The guide surfaces 4 are formed on the antenna 3 and are connected respectively to the recess-defining walls 3211 of the second engaging portions 321 of the coupling section 32 of the antenna 3. It should be noted that the guide surfaces 4 may be formed on the wall sections 2171 of the first slit-defining wall 217 of the surrounding wall 21 of the connecting component 2 in other embodiments of this invention.

In use, the antenna 3 is movable relative to the connecting component 2 between a first position (see FIG. 3), where the coupling section 32 of the antenna 3 extends into the first slit 22 in the antenna connecting portion 219 of the surrounding wall 21 of the connecting component 2, and where the second engaging portions 321 of the coupling section 32 of the antenna 3 is clamped tightly between the first engaging portions 215 of the antenna connecting portion 219, and a second position (see FIG. 4), where the coupling section 32 of the antenna 3 ceases to extend into the first slit 22. When the antenna 3 is rotated from the second position to the first position, the antenna 3 extends into the first slit 22 with guidance of the guide surfaces 4, i.e., the guide surfaces 4 are disposed for guiding movement of the antenna 3 to the first position. When the antenna 3 is at the second position, the abutment wall segment 2181 of the second slit-defining wall 218 of the antenna connecting portion 219 abuts against the stop surface 322 of the coupling section 32 of the antenna 3 so as to limit the rotating angle of the antenna 3. Since the antenna 3 is clamped between the first engaging portions 215 so as to be positioned relative to the connecting component 2, the antenna 3 can still be positioned firmly relative to the connecting component 2 even after long-term use.

It should be further noted that the second engaging portions 321 of the coupling section 32 of the antenna 3 may be omitted in other embodiments of this invention. Moreover, the connecting component 2 may extend integrally from the receiver 1 in other embodiments of this invention such that the third slits 25 and the flanges 26 can be omitted. Furthermore, while this invention is exemplified using a plurality of pivot portions 24, only one pivot portion 24 may be employed in other embodiments of this invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An antenna device adapted for use with a receiver, said antenna device comprising:

a connecting component having a surrounding wall that defines a receiving space and that has a receiver connecting portion adapted to be connected to the receiver, and an antenna connecting portion extending from said receiver connecting portion in a longitudinal direction, said antenna connecting portion having a first end surface and a first slit that extends from said first end surface in the longitudinal direction toward said receiver connecting portion and that is in spatial communication with said receiving space, said first slit being defined by a first slit-defining wall having a pair of wall sections opposite to each other in a first transverse direction transverse to the longitudinal direction, said antenna connecting portion further having a pair of first engaging portions formed on said wall sections of said first slit-defining wall, respectively; and an antenna connected pivotally to said antenna connecting portion of said surrounding wall of said connecting component and movable relative to said connecting component between a first position, where said antenna extends into said first slit in said antenna connecting portion and is clamped tightly between said first engaging portions of said surrounding wall, and a second position, where said antenna ceases to extend into said first slit.

2. The antenna device as claimed in claim 1, wherein one of said wall sections of said first slit-defining wall of said antenna connecting portion and said antenna is formed with guide surfaces for guiding movement of said antenna to the first position.

3. The antenna device as claimed in claim 2, wherein said guide surfaces are formed on said antenna.

4. The antenna device as claimed in claim 1, wherein said antenna is formed with a pair of second engaging portions clamped tightly between said first engaging portions when said antenna is at the first position.

5. The antenna device as claimed in claim 4, wherein said first engaging portions of said antenna connecting portion of said surrounding wall of said connecting component have a shortest distance therebetween that is slightly shorter than that between said second engaging portions of said antenna.

6. The antenna device as claimed in claim 4, wherein each of said second engaging portions of said antenna is in a form of a recess, and each of said first engaging portions of said antenna connecting portion of said surrounding wall of said connecting component is in a form of a protrusion.

7. The antenna device as claimed in claim 6, wherein one of said wall sections of said first slit-defining wall of said antenna connecting portion and said antenna is formed with guide surfaces for guiding movement of said antenna to the first position.

8. The antenna device as claimed in claim 7, wherein each of said second engaging portions of said antenna has a recess-defining wall, and said guide surfaces are formed on said antenna and are connected to said recess-defining walls of said second engaging portions, respectively.

9. The antenna device as claimed in claim 4, wherein:

said antenna has a transceiver section, and a coupling section that extends from said transceiver section, that is connected pivotally to said antenna connecting portion of said surrounding wall of said connecting component, and that is formed with said second engaging portions and a stop surface at one edge distal from said transceiver section; and said antenna connecting portion further has a second slit that extends from said first end surface in the longitudinal direction toward said receiver connecting portion, that is disposed at a position opposite to said first slit in a second transverse direction transverse to the longitudinal direction and the first transverse direction, and that is in spatial communication with said receiving space, said second slit being defined by a second slit-defining wall having an abutment wall segment that is spaced apart from said first end surface in the longitudinal direction and that is disposed to abut against said stop surface of said coupling section when said antenna is at the second position.

10. The antenna device as claimed in claim 9, wherein said first engaging portions of said antenna connecting portion of said surrounding wall of said connecting component have a shortest distance therebetween that is slightly shorter than that between said second engaging portions of said coupling section of said antenna.

11. The antenna device as claimed in claim 9, wherein each of said second engaging portions of said coupling section of said antenna is in a form of a recess, and each of said first engaging portions of said antenna connecting portion of said surrounding wall of said connecting component is in a form of a protrusion.

12. The antenna device as claimed in claim 11, wherein one of said wall sections of said first slit-defining wall of said antenna connecting section and said antenna is formed with guide surfaces for guiding movement of said antenna to the first position.

13. The antenna device as claimed in claim 12, wherein each of said second engaging portions of said coupling section of said antenna has a recess-defining wall, and said guide surfaces are formed on said antenna and are connected to said recess-defining walls of said second engaging portions, respectively.

14. The antenna device as claimed in claim 9, wherein:

said coupling section of said antenna is further formed with a pivot hole; and said antenna connecting portion of said surrounding wall of said connecting component further has an internal surrounding surface provided with a pivot portion that extends into said pivot hole to connect pivotally said antenna to said antenna connecting portion.

15. The antenna device as claimed in claim 1, wherein said receiver connecting portion of said surrounding wall of said connecting component has a second end surface that is formed opposite to said first end surface of said antenna connecting portion of said surrounding wall in the longitudinal direction, a plurality of spaced apart third slits that extend from said second end surface in the longitudinal direction toward said antenna connecting portion, that are in spatial communication with said receiving space, and that impart resiliency to said receiver connecting portion, and an external surrounding surface that is formed with a flange adapted for coupling said connecting component to the receiver.

* * * * *